US007806232B2

(12) United States Patent
Thomas et al.

(10) Patent No.: US 7,806,232 B2
(45) Date of Patent: Oct. 5, 2010

(54) ROOF PERIMETER CABLE GUARD SYSTEM

(76) Inventors: Kenneth R. Thomas, 3915 Shamrock Rd., Jefferson City, MO (US) 65101; Ronald A. Kempker, 5922 Rt. M, Jefferson City, MO (US) 65101

( * ) Notice: Subject to any disclaimer, the term of this patent is extended or adjusted under 35 U.S.C. 154(b) by 1117 days.

(21) Appl. No.: 11/355,107

(22) Filed: Feb. 16, 2006

(65) Prior Publication Data

US 2006/0180391 A1 Aug. 17, 2006

Related U.S. Application Data

(60) Provisional application No. 60/653,495, filed on Feb. 17, 2005.

(51) Int. Cl.
*E04G 3/26* (2006.01)

(52) U.S. Cl. ..... 182/45; 182/113

(58) Field of Classification Search ..... 182/45, 182/113; 256/DIG. 6

See application file for complete search history.

(56) References Cited

U.S. PATENT DOCUMENTS

| | | | | | |
|---|---|---|---|---|---|
| 3,452,956 | A * | 7/1969 | Reed | 248/237 |
| 3,880,405 | A * | 4/1975 | Brueske | 256/59 |
| 3,995,833 | A * | 12/1976 | McLaughlin et al. | 256/59 |
| 4,666,131 | A | 5/1987 | Kettelkamp, Sr. et al. | |
| 5,573,227 | A | 11/1996 | Hemauer et al. | |
| 5,586,423 | A | 12/1996 | Mullen | |
| 5,653,308 | A * | 8/1997 | White | 182/138 |
| 5,711,398 | A * | 1/1998 | Bartholomew | 182/45 |
| 5,730,246 | A * | 3/1998 | Beard | 182/45 |
| 6,038,829 | A | 3/2000 | Franks | |
| 6,053,281 | A | 4/2000 | Murray | |
| 6,270,057 | B1 * | 8/2001 | Highley et al. | 256/32 |
| 6,276,668 | B1 * | 8/2001 | Sweeley | 256/59 |
| 6,585,080 | B2 | 7/2003 | Murray | |
| 2006/0180390 | A1 * | 8/2006 | Thaler | 182/45 |

FOREIGN PATENT DOCUMENTS

| | | | |
|---|---|---|---|
| FR | 2589182 | A1 * | 4/1987 |
| GB | 2 243 397 | A | 10/1991 |

* cited by examiner

*Primary Examiner*—Alvin C Chin-Shue
(74) *Attorney, Agent, or Firm*—Richard C. Litman

(57) ABSTRACT

A roof perimeter cable guard system has a main stanchion member supported at its lower end by an anchor bracket screwed to the roof perimeter. A main brace member extends outward and downward from the upper end portion of the main stanchion member and curves around and under the perimeter feature. The main brace has a lower sleeve receiving an adjustable wall-engaging member to provide bracing against the wall of the structure. In one configuration the wall-engaging member has an additional supporting extender member, which allows the wall-engaging member to engage the soffit of an overhang. An inward extender member and parapet engagement bracket allow for position attachment to a parapet feature. Pairs of barrier cable engagement brackets having barrier cable receiving slots are spaced along the inner side of the stanchion vertical members for easy insertion or removal of an equal number of barrier cables, normally three.

18 Claims, 9 Drawing Sheets

ROOF PERIMETER CABLE GUARD SYSTEM

CROSS-REFERENCE TO RELATED APPLICATION

This application claims the benefit of U.S. Provisional Patent Application Ser. No. 60/653,495, filed Feb. 17, 2005.

BACKGROUND OF THE INVENTION

1. Field of the Invention

The present invention relates to safety systems for construction. More particularly, the present invention relates to a roof perimeter cable guard system that provides a safety guard rail and line system for installation on roofs.

2. Description of the Related Art

The use of safety guardrail systems for installation around the perimeter of a roof during construction and roof repair is widely practiced. Such a system protects workers from accidental falls from a roof and the injuries thereby incurred. Most systems include a number of posts or uprights affixed to the roof and configured to support railings of framing lumber and the like, such as 1"×4" or 2"×4" lumber. The use of lumber results in a necessarily heavy installation due to the inherent weight of the lumber, thereby exposing workers to risk and substantial effort in installing and removing the lumber and supporting uprights. Of course, metal or plastic rails could be substituted, but they would also suffer due to inherent weight and difficulty in handling safety rails.

The use of uprights or stanchions to support wire rope or other cable as barrier lines in place of lumber is known. However, stanchion designs are limited in adapting to various forms of roof perimeters, such as parapet and overhang, and require a stanchion of substantial strength and resulting weight to support the cables under tension. It would be desirable to provide a stanchion system that provides for easy installation on a variety of roof perimeter designs that is light in weight while providing adequate strength to support the cable barrier lines under necessary tension.

Thus, a roof perimeter cable guard system solving the aforementioned problems is desired.

SUMMARY OF THE INVENTION

The roof perimeter cable guard system of the present invention provides a substantially vertical stanchion member supported at its lower end by an anchor bracket screwed to the outer edge of the roof perimeter feature to which it attaches. A main brace member extends outward and downward from the upper end portion of the main stanchion member and curves around and under the roof perimeter feature. The lower portion of the main brace has a sleeve for receiving an adjustable wall-engaging member to provide bracing against the wall of the structure.

In one configuration the wall-engaging member has an additional supporting extender member, which allows the wall-engaging member to engage the soffit of an overhang. In another configuration, an inward extender member and parapet engagement bracket allow for position attachment to a parapet roof feature.

Pairs of barrier cable engagement brackets having barrier cable receiving slots are spaced along the inner side of the stanchion vertical members for easy insertion or removal of an equal number of barrier cables, normally three in number. A mid-span barrier cable support and a barrier cable engagement bracket attachment may also be provided.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is a roof perimeter cable guard system having a substantially vertical stanchion member supported at its lower end by an anchor bracket screwed to the outer edge of the roof perimeter feature to which it attaches.

Figure 1:
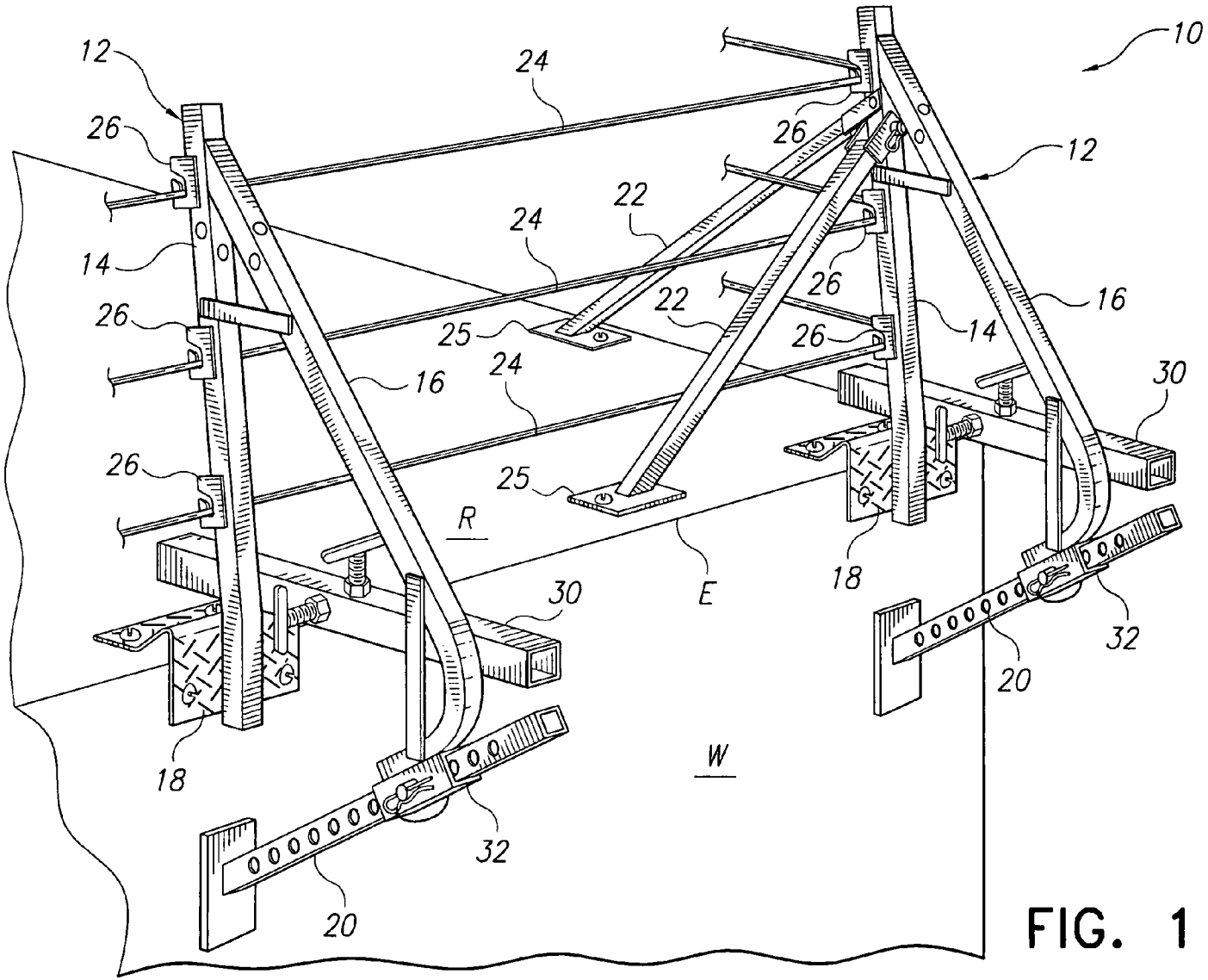
FIG. 1 is an environmental, perspective view of a roof perimeter cable guard system according to the present invention.
Figure 2:
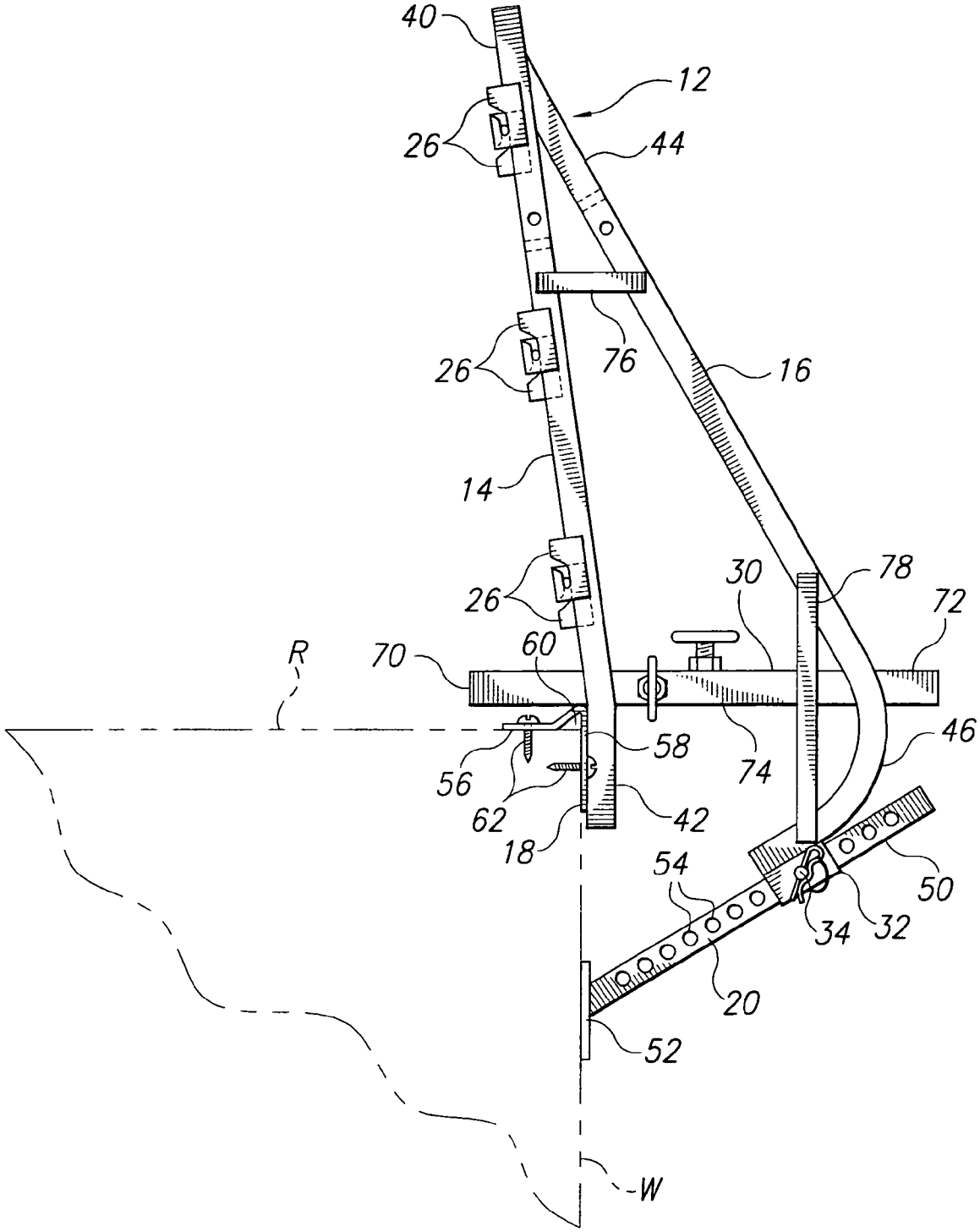
FIG. 2 is a side elevation view of the stanchion of the system of FIG. 1.

Referring to FIGS. 1 and 2, there is shown an environmental perspective view and a side elevation view, respectively, of the roof perimeter cable guard system 10 of the present invention as mounted at the perimeter of roof R at wall W. Roof safety system 10 includes stanchions 12 made up, principally, of: an elongate stanchion vertical member 14 installed on the perimeter of roof R at wall W; a main brace member 16 extending outwardly and downward from the upper portion of vertical member 14, the main brace member 16 having a lower, inwardly curved portion; and a stanchion brace and receiver 30 extending between a lower portion of the vertical stanchion member 14 and the lower curved portion of the stanchion main brace member 16. Vertical member 14 is supported at the edge of the roof feature by anchor bracket 18 (also known as the "gravel stop"), which may be affixed to the roof R and wall W by screws, as shown, or by other fasteners.

Figure 3:
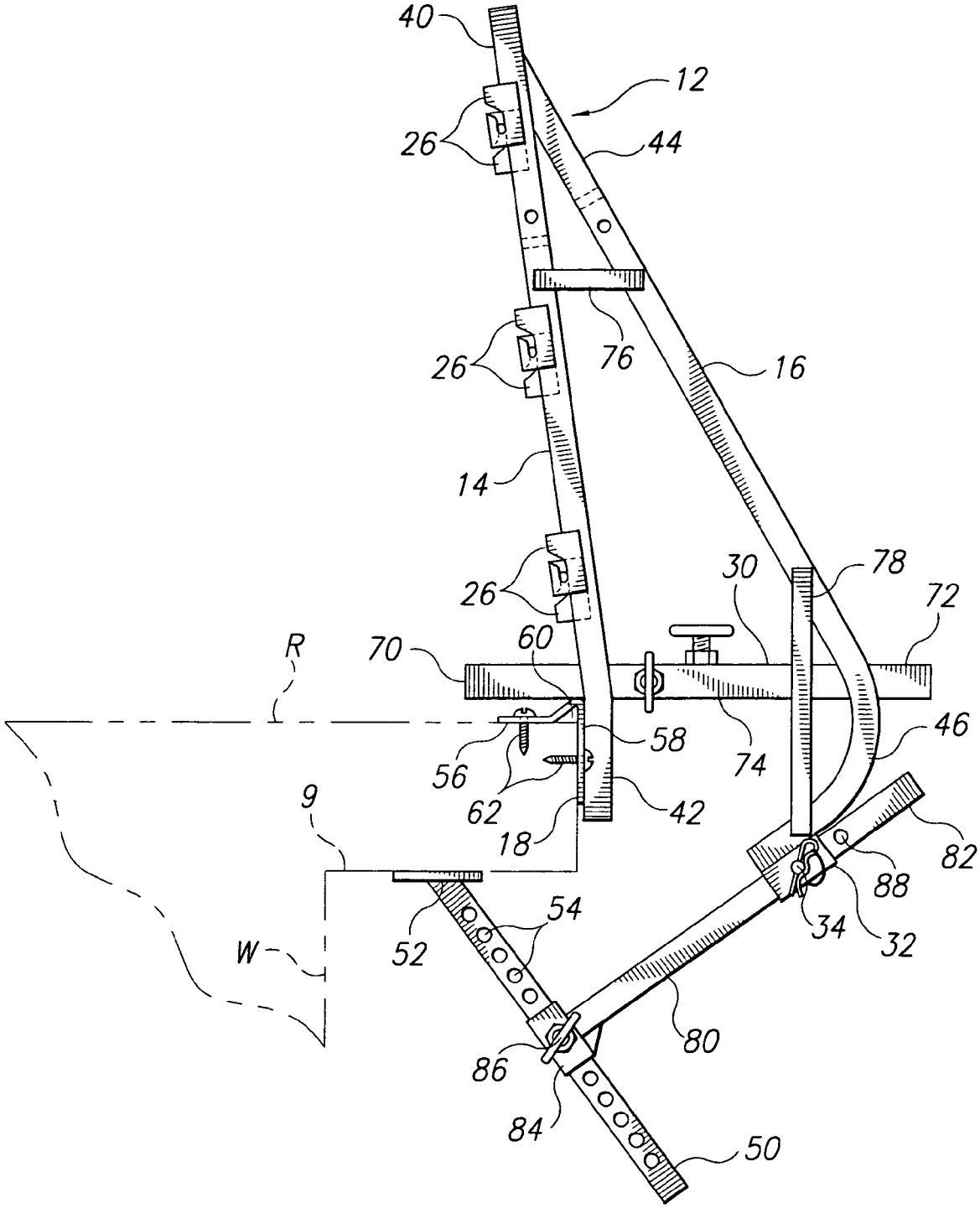
FIG. 3 is a side elevation view of the stanchion of the system of FIG. 1 modified for installation on a roof overhang.
Figure 4:
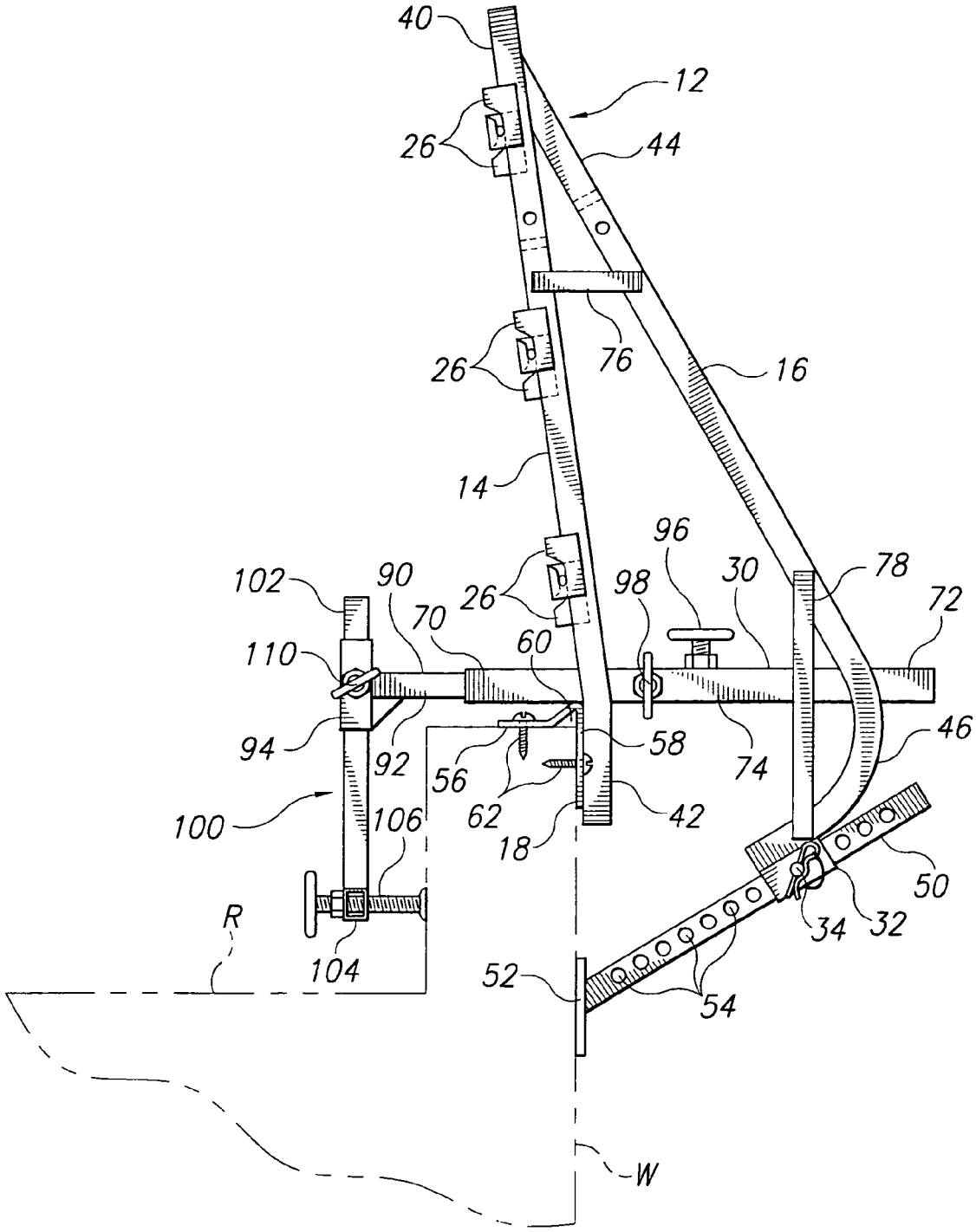
FIG. 4 is a side elevation view of the stanchion of the system of FIG. 1 modified for installation on a roof parapet.

Stanchion vertical members 14 and main brace members 16 may be made from square tubing, e.g., 1" square tubing, for light weight and strength. As shown in FIG. 2, vertical members 14 need not be straight or linear, but may be angled or canted at the lower end in order to slope inward above the edge of the roof R. For example, when the distance between two parallel barrier cables extending through the lowermost and uppermost point on the vertical member 14 is fifty-two inches, the vertical member 14 may have an angle of about 83° formed therein about six inches from the bottom of vertical member 14, so that the top end of the vertical member 14 extends about six inches inward over the roof R, as shown in FIGS. 2-4. In this way, a worker falling against the barrier cables will not have the upper portion of his or her body directly at the edge of the roof R, but bent back inward towards the interior of the roof R, so that torque, inertia, and momentum do not cause the worker's body to continue rotation or falling towards, or over, the edge of the roof R.

The lower curved portion of the stanchion main brace member 16 extends below the lower or bottom end of the vertical member 14 and supports an adjustable wall-engaging member 20 by means of a sleeve 32, providing additional support to the stanchion 12 to avoid collapse upon a worker falling against a stanchion 12 or barrier cable 24 supported thereby. Additional roof mount supports 22 may be provided at corner stanchions 12 and at selected stanchions 12 along a wall to provide additional support against the inward stress imparted by the cable or wire rope barrier cables 24 as strung around the roof R. Roof mount supports 22 have a lower plate 25 screwed to the roof R as shown and are pinned at their upper ends to the upper end of vertical member 14 as shown, or main brace member 16 (see open pin bores as shown).

Pairs of barrier cable engagement brackets 26 (a single pair is shown in more detail in FIG. 5) are spaced along vertical members 14 for removably supporting barrier cables 24, three pairs of brackets 26 and three barrier cables 24 being shown in FIGS. 1 and 2. The curved lower portion of the stanchion main brace member 16, along with the wall engaging member 20, allows the system to be applied over gutters and the like.

Referring more particularly to FIG. 2, main brace lower sleeve 32 is affixed on the curved lower portion 46 of main brace 16, e.g., by welding, and adjustably receives the shank portion 50 of wall-engaging member 20 in order to provide support by means of wall engaging pad 52. Sleeve pin 34 is selectively inserted through sleeve 32 and pin adjustment bores 54 spaced along tubular shank 50 to provide desired bracing of stanchion 12. Vertical member 14 has an upper portion 40 to which upper portion 44 of main brace member 16 is attached. Vertical member 14 has a lower portion 42 attached by welding or the like to anchor bracket 18 along bracket vertical wall 58, which is attached to wall W by mounting screws 62. Anchor bracket 18 has a roof engaging portion 56 extending horizontally inward, which is attached to roof R by mounting screws 62. An upper bend 60 is provided in roof engaging portion 56 to space and support lower brace and receiver member 30 therefrom.

Lower brace and receiver member 30 has an inner portion 70 extending inward from vertical member 14, an outer portion 72 extending outward from the lower portion 46 of main brace member 16, and a center portion 74 between the lower portion 42 of vertical member 14 and the lower portion 46 of main brace member 16. An upper horizontal brace 76 is attached between the respective upper portion of vertical member 14 and main brace member 16 to further strengthen the structure of stanchion 12. A lower vertical brace 78 is placed across the arcuate lower portion of main brace member 16 to keep the arcuate lower portion rigid. Braces 76 and 78 may be made from any rigid material, e.g., a flat bar, a strap, a rod, etc.

Figure 6:
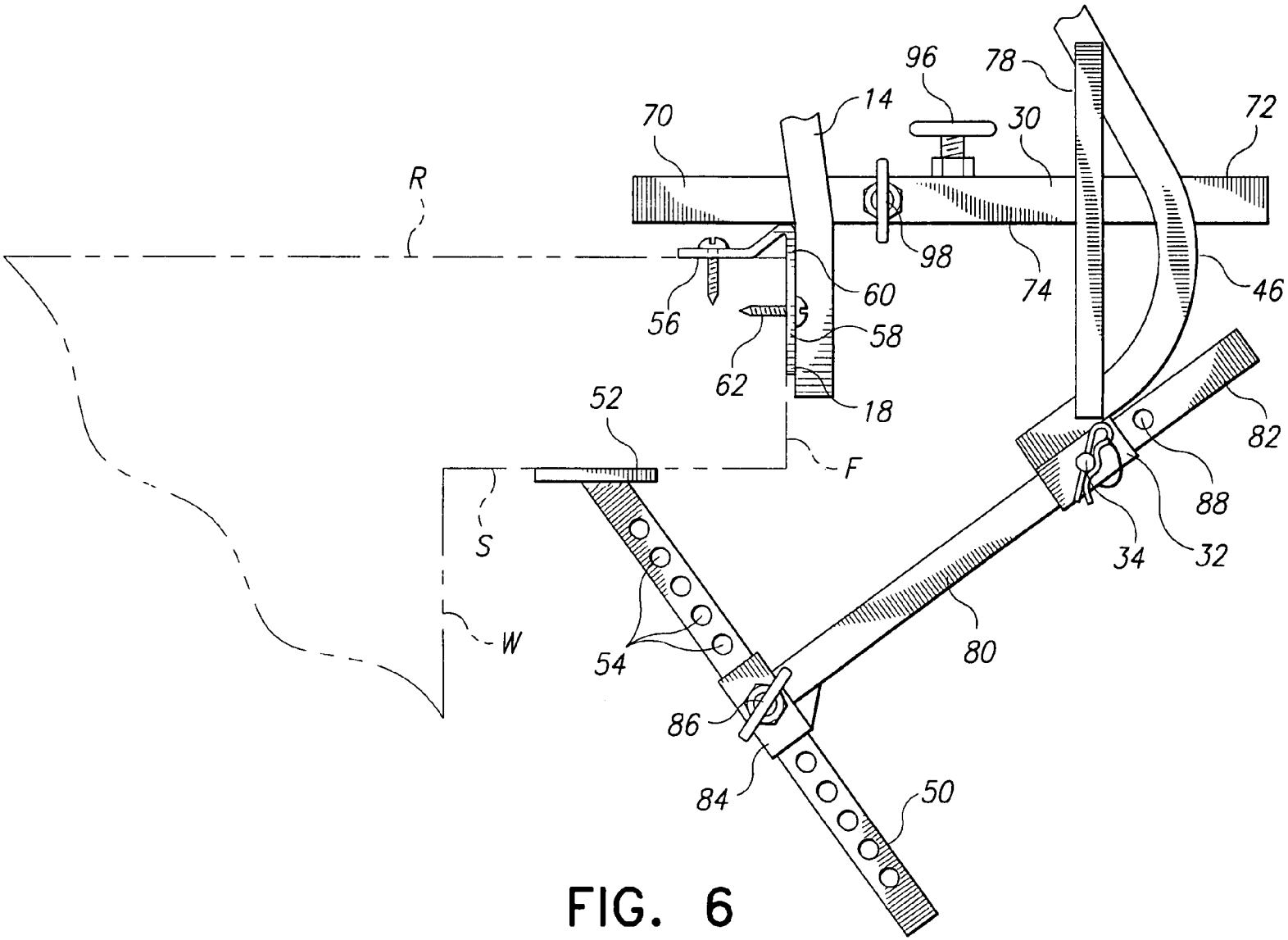
FIG. 6 is a detail side elevation view of the mounting system of FIG. 3.

Referring to FIGS. 3 and 6, there is shown side elevation views of a stanchion 12 in another configuration in full view and detail view, respectively, specifically configured to fit an overhang peripheral roof feature. Roof R has a fascia F and a soffit S extending outward from wall W. Stanchions 12 are mounted at the periphery of roof R in the same manner as in that of FIG. 2 by means of anchor bracket 18. An additional part, extender member 80, is added to redirect the shank portion of wall engaging member 50 upward against soffit S at wall engaging pad 52.

Extender member 80 has a shank 82 and an end sleeve 84, shank 82 being adjustably received by sleeve 32 of stanchion main brace member 16 by a pin 34 extending through a selected adjustment bore 88. The extender member 80 extends downward and inward from sleeve 32 and receives the shank of wall-engaging member 50 within extender member end sleeve 84 and is selectively fixed in place by setscrew 86. Wall-engaging pad 52 is held against soffit S by the extension upward of the shank of wall-engaging member 50 through sleeve 84 providing, along with anchor bracket 18, a clamping action over the overhang feature of roof R.

Figure 7:
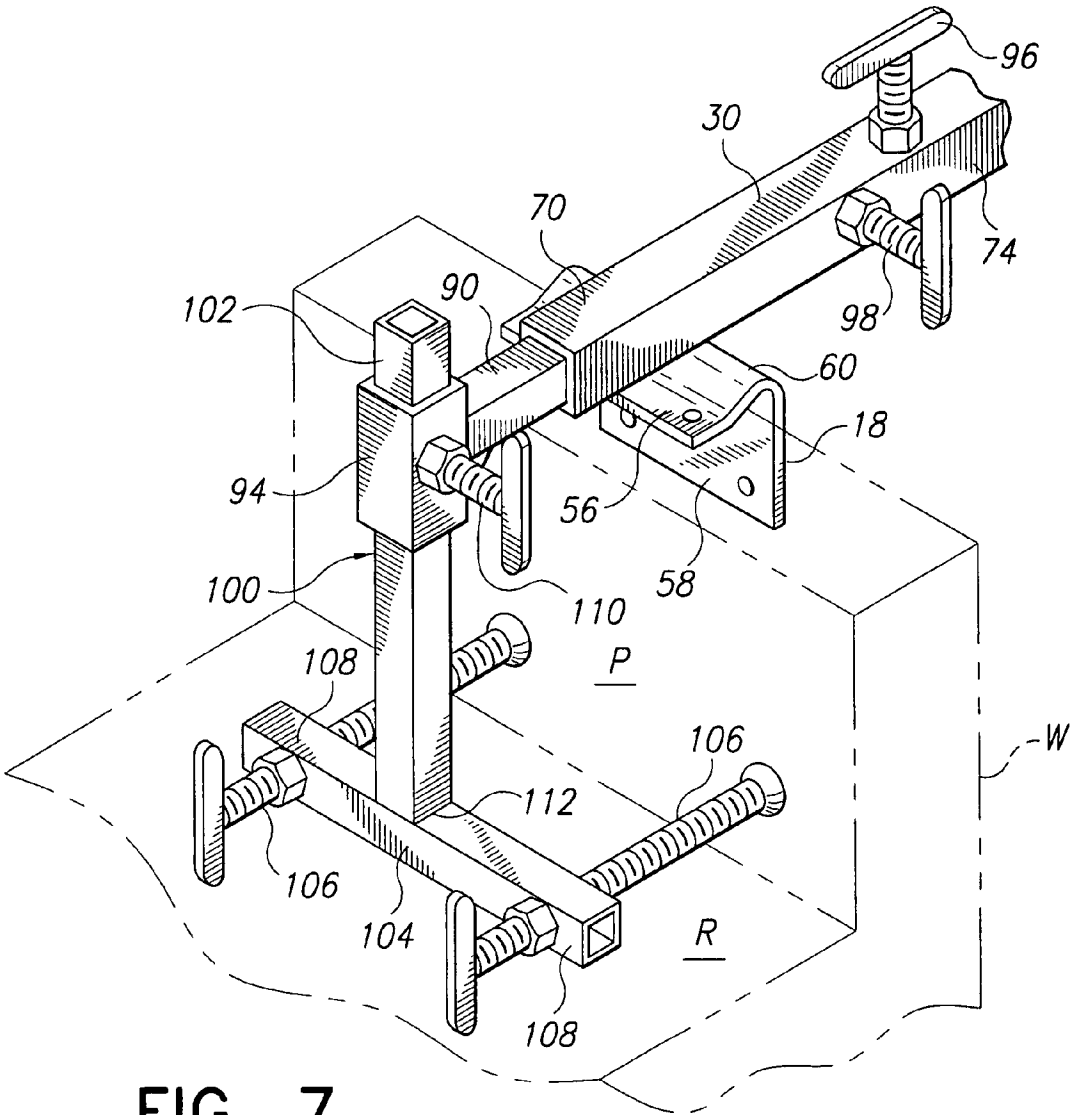
FIG. 7 is a detail perspective view of the parapet engaging system of FIG. 4.

Referring to FIGS. 4 and 7, there is shown a side elevation view and a detail perspective view, respectively, of stanchion 12 in another configuration for attachment to a parapet P peripheral feature of roof R and from which wall W descends. Stanchion 12 may be attached to the outer edge of the parapet P by mounting screws 62 through anchor bracket 18 in the manner of the mounting shown in FIG. 1. Alternatively, the anchor bracket 18 may be held in place by the clamping action of wall-engaging pad 52 and clamp screw 106. In addition, a stanchion lower brace extender member 90 has a shank 92 slidably engaged within tubular stanchion lower brace and receiver 30 to be adjustably secured at a desired extension by lower brace vertical setscrew 96 and lower brace horizontal setscrew 98. Extender member 90 is horizontally disposed and has a vertical end sleeve 94 at its inner end relative to the roof R for receiving vertical shank 102 of parapet engagement bracket 100.

Vertical shank 102 is adjustably secured in vertical end sleeve 94 by setscrew 110. Parapet engagement bracket 100 is vertically disposed and is formed in the shape of an inverted "T" (see FIG. 7). A horizontal clamp support member 104 is centrally secured to the lower end of vertical shank 102 at central "T" 112 and extends outward to clamp support member end portions 108. Clamp screws 106 are mounted horizontally through clamp support member end portions 108 and are adjusted to bear against the inner side of parapet P. The clamping force exerted by the clamp screw 106 and the stanchion anchor bracket 18 provide for secure attachment and easy detachment of stanchion 12 from parapet P.

Figure 5:
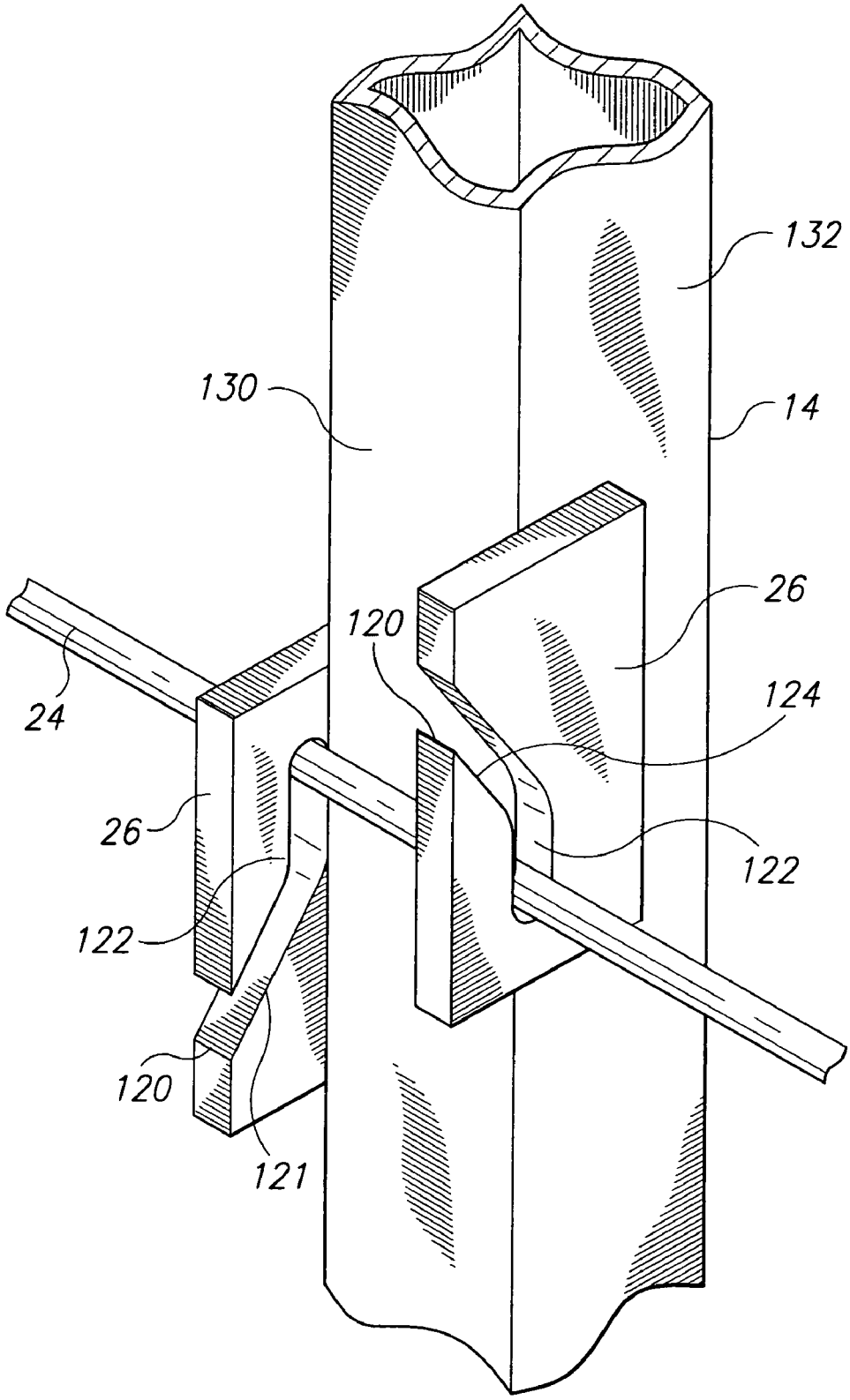
FIG. 5 is a detail perspective view of the stanchion vertical member of FIG. 1 showing a pair of barrier cable engagement brackets thereon supporting a barrier cable.

Referring to FIG. 5, there is shown a detail view from the perspective of the interior of the roof showing barrier cable 24 held in a pair of engagement brackets 26. Engagement brackets 26 are attached to opposing vertical stanchion sidewalls 132, as by welding, and are inverted relative to each other to secure barrier cable 24 along vertical stanchion inner side 130. Engagement brackets 26 have receiving slots 120 angled into vertical retainment slots 122. The barrier cable 24 is slackened for removal and mounting through adjacent receiving slots and tensioned to be securely held in retainment slots 122.

Figure 8:
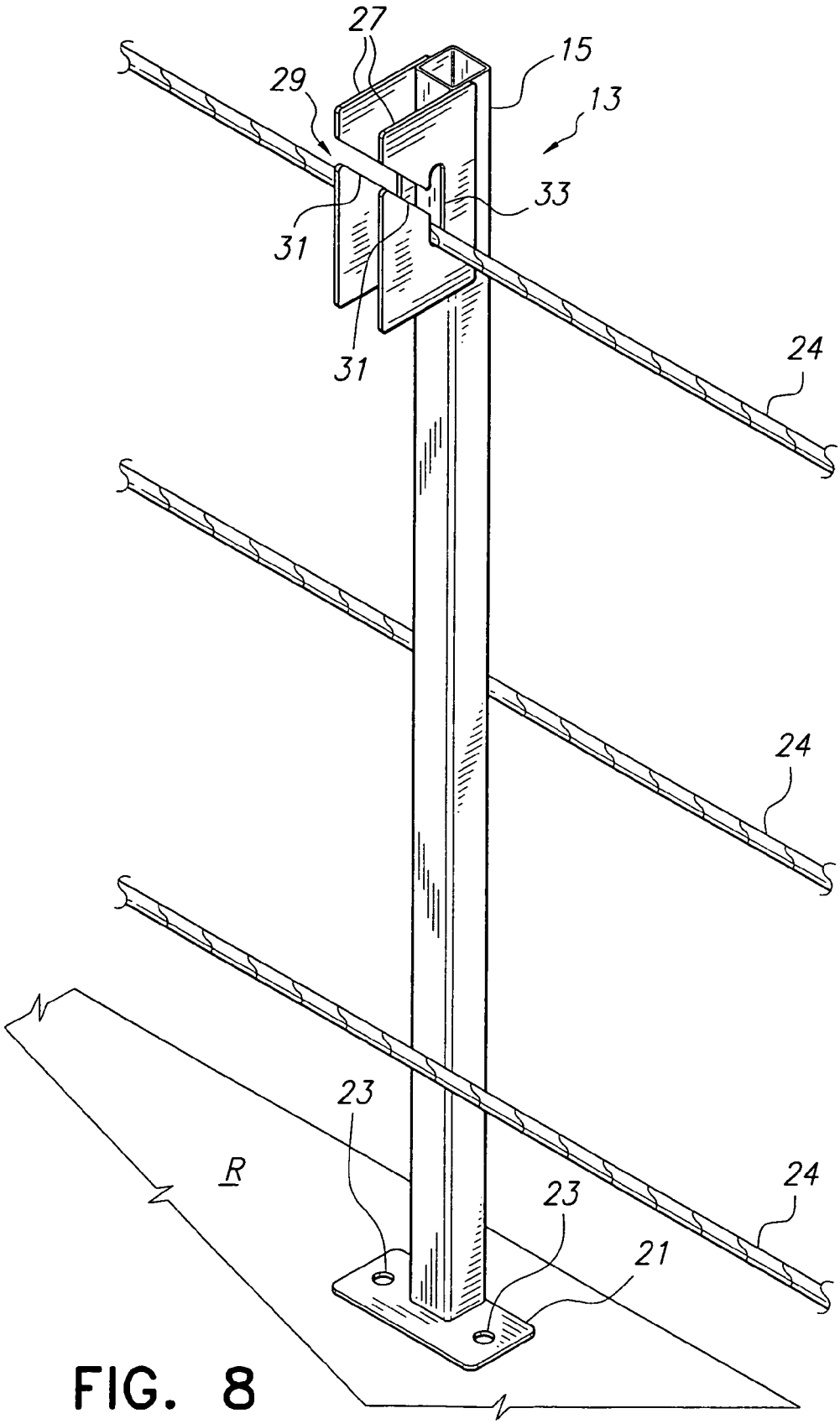
FIG. 8 is an environmental, perspective view of a mid-span support to be used with the perimeter cable guard system of FIG. 1.

Referring to FIG. 8, there is shown a perspective view of a mid-span support 13 for supporting barrier cable 24 at mid-span, i.e., between a pair of stanchions 12. The mid-span support 13 is made up of a support post 15 having a horizontal base plate member 21 affixed to the bottom of post 15, which includes holes 23 for receiving fasteners, such as screws or nails, for securing post 15 to roof R. Adjacent to the top end of support post 15 are a pair of barrier cable support brackets 27 for supporting the top barrier cable 24. The support brackets 27 are a pair of plates affixed to the sidewall of the support post 15. Each bracket 27 includes a barrier cable support slot 29 having a downwardly angled receiving slot 31 and a substantially vertical retainment slot 33.

Mid-span supports 13 are placed as needed between stanchions 12 and are used to hold or prop up barrier cable 24. This becomes necessary should the distance between adjacent stanchions 12 be too great due to particular roof structure characteristics, causing the barrier cable 24 to sag below an acceptable limit. Mid-span support 13 can then be put into place, thereby holding the barrier cable 24 at an acceptable height. As shown in FIG. 8, support post 15 may be woven between the three barrier cables 24 for greater stability of the mid-span support 13.

Figure 9:
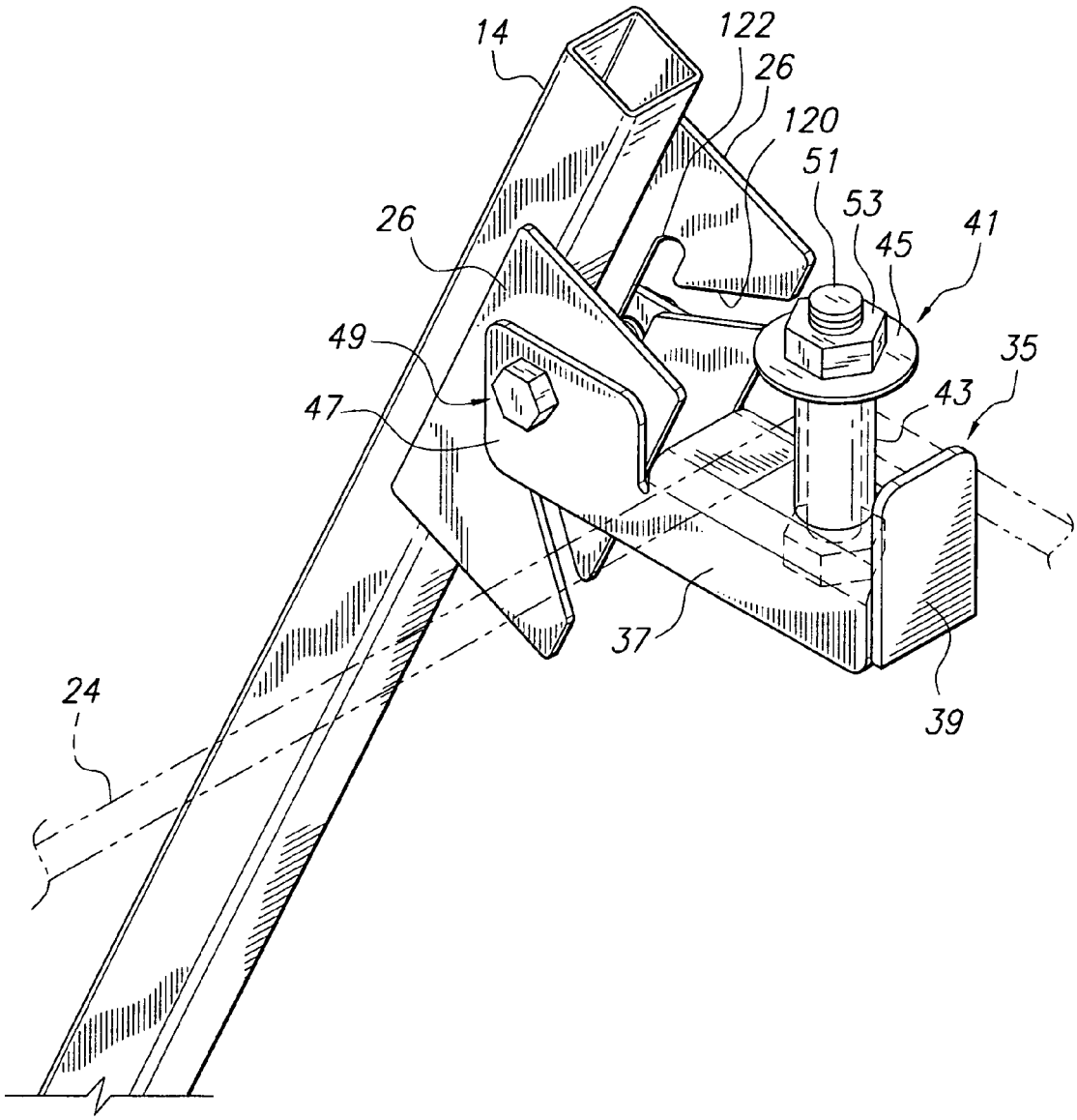
FIG. 9 is a detail perspective view of the stanchion vertical member of FIG. 1 showing a pair of barrier cable engagement brackets thereon, and a barrier cable engagement bracket attachment.

Referring to FIG. 9, there is shown a barrier cable engagement bracket attachment 35 for attachment to a pair of barrier cable engagement brackets 26 in order to a support barrier cable 24 in a non-binding fashion. The attachment 35 has a forward base portion 37, a pair of substantially vertical, rearwardly extending wall members 47 and an upstanding forward plate 39. A rotatable bushing 41, which includes a cylindrical body portion 43 and an outwardly extending circular flange 45 at the top of the cylindrical body portion 43, rests on base portion 37. The rotatable bushing 41 is rotatably secured to the base portion 37 by a bolt 51 extending through an aperture in the base portion 37 and through the bushing 41. The bushing 41 is secured by nut 53, which is tightened on the bolt 51 enough to secure bushing 41 on bolt 51, but without precluding rotation of bushing 41 about bolt 51.

The attachment 35 may be secured into the retainment slots 122 of any pair of barrier cable engagement brackets 26 by a fastener 49, such as a bolt or pin, extending through holes in the rear portions of wall members 47. Once attachment 35 is in place, barrier cable 24 is supported on base portion 37, behind the cylindrical body portion 43 of rotatable bushing 41. Circular flange 45 acts to prevent the barrier cable 24 from riding up and off of the rotatable bushing 41. While attachment 35 may be mounted on any pair of barrier cable engagement brackets 26, it is most useful on the brackets 26 of stanchions 12 where the barrier cable changes direction, for example, at the corner of a building roof, and where the barrier cable 24 would have a tendency to bind in the retainment slots 122 of brackets 26. This allows for a more complete tightening of the barrier cables 24.

The stanchion of the roof safety system as described above is preferably made from aluminum for ease of handling, the design being such as to allow the use of aluminum without bending or failure in use. However, the stanchion may also be made of steel or other suitable material.

It is to be understood that the present invention is not limited to the embodiments described above, but encompasses any and all embodiments within the scope of the following claims.

We claim:

1. A stanchion for a roof perimeter cable guard system for installation around a periphery of a roof, the stanchion comprising:

a vertical member having an upper end portion, and a lower portion;

at least one pair of barrier cable engagement brackets mounted on the vertical member for releasably supporting at least one barrier cable;

an anchor bracket having an upper horizontal portion adapted for attachment to the periphery of the roof and a vertical portion adapted for abutting a wall normal to the roof, the lower portion of the vertical member being attached to the vertical portion of the anchor bracket;

a main brace member having a linear upper portion joined to the upper portion of the vertical member adjacent the upper end portion thereof at an acute angle and an arcuate lower portion curving towards, and extending lower than, the lower portion of the vertical member, the lower portion of the main brace member having a main brace lower sleeve attached thereto;

a wall-engaging member having an elongate shank portion slidable within the main brace lower sleeve, a wall-engaging pad at an end of the shank portion for engagement with the wall, and means for selectively fixing the shank portion in order to adjust the length of the wall-engaging member to support the main brace member against the wall with the main brace member extending outward from the roof; and further comprising a lower brace and receiver member joined horizontally between the lower portions of said vertical member and the arcuate lower portion of said main brace member, the lower brace and receiver member being an elongate tubular member having an inner portion extending inwardly from said vertical member and an outer portion extending outwardly from the lower portion of said main brace member.

2. The stanchion according to claim 1, further comprising:

an extender member having an elongate shank and an end sleeve attached to an end of the shank normal thereto, the extender member shank being slidable within said main brace member sleeve and said wall-engaging shank being slidable within the extender member end sleeve; and means for selectively fixing the shank of the extender member to the main brace sleeve in order to raise the wall-engaging pad of said wall-engaging member to engage a soffit under a roof overhang.

3. The stanchion according to claim 1 further comprising:

a lower brace and receiver member extender slidable within said lower brace and receiver member; and a parapet engagement bracket adjustably supported by the lower brace and receiver member extender for mounting the stanchion on a roof with a peripheral parapet.

4. The perimeter cable guard system according to claim 3, wherein:

said lower brace and receiver member extender has a shank having a first end adjustably secured within the inner portion of said lower brace and receiver member, and an end sleeve mounted normal to an opposite second end of said shank; and said parapet engagement bracket has an inverted T-shape formed by a shaft adjustably secured within the lower brace and receiver end sleeve and a crossbar clamp support member centrally secured to the lower end of the shaft; the system further comprising:

a pair of adjustable clamp screws extending through the crossbar clamp support member, the clamp support screws being adapted for bearing against an inner side of a parapet in order to attach the stanchion to a roof having a parapet structure.

5. The stanchion according to claim 1, further comprising at least one additional roof mount support, the at least one additional roof mount support being an elongated, tubular member having a first end pivotally attached to said vertical member and an opposite end having a plate attached thereto adapted for attachment to the roof.

6. The stanchion according to claim 1, wherein said at least one pair of barrier cable engagement brackets includes three pairs of barrier cable engagement brackets, each of said engagement brackets being a plate member attached to the vertical member sidewall, each plate member having an angled barrier cable receiving slot and a substantially vertical barrier cable retainment slot extending from the receiving slot defined therein.

7. The stanchion according to claim 1, further comprising at least one barrier cable engagement bracket attachment, the bracket attachment having:

a planar base portion having a shaft extending normal thereto;

a pair of substantially vertical, rearwardly extending wall members extending normal to the base member; and a rotatable bushing having a cylindrical body portion and an enlarged, outwardly extending circular flange at one end of the body portion, the bushing being rotatably mounted on the shaft; and a fastener member attaching the wall members of the engagement bracket attachment to said at least one pair of barrier cable engagement brackets, whereby said at least one barrier cable may engage and be supported by said base portion and said rotatable bushing.

8. The stanchion according to claim 1, wherein said vertical member is bent at an angle so that the upper portion of said vertical member extending above said anchor bracket slopes inward over the periphery of the roof, being adapted to set the barrier cables back from an edge of the roof.

9. A roof perimeter cable guard system for installation around the periphery of a roof, comprising a plurality of stanchions and at least one barrier cable supported thereby, each of the stanchions including:

a vertical member having an upper end portion, and a lower portion;

at least one pair of barrier cable engagement brackets mounted on the vertical member releasably supporting the at least one barrier cable;

an anchor bracket having an upper horizontal portion adapted for attachment to the periphery of the roof and a vertical portion adapted for abutting a wall normal to the roof, the lower portion of the vertical member being attached to the vertical portion of the anchor bracket;

a main brace member having a linear upper portion joined to the upper portion of the vertical member adjacent the upper end portion thereof at an acute angle and an arcuate lower portion curving towards, and extending lower than, the lower portion of the vertical member, the lower portion of the main brace member having a main brace lower sleeve attached thereto;

a wall-engaging member having an elongate shank portion slidable within the main brace lower sleeve, a wall-engaging pad at an end of the shank portion for engagement with the wall, and means for selectively fixing the shank portion in order to adjust the length of the wall-engaging member to support the main brace member against the wall with the main brace member extending outward from the roof; and wherein each said stanchion further comprises a lower brace and receiver member joined horizontally between the lower portions of said vertical member and the arcuate lower portion of said main brace member, the lower brace and receiver member being an elongate tubular member having an inner portion extending inwardly from said vertical member and an outer portion extending outwardly from the lower portion of said main brace member.

10. The perimeter cable guard system according to claim 9, wherein each said stanchion further comprises:

an extender member having an elongate shank and an end sleeve attached to an end of the shank normal thereto, the extender member shank being slidable within said main brace member sleeve and said wall-engaging shank being slidable within the extender member end sleeve; and means for selectively fixing the shank of the extender member to the main brace sleeve in order to raise the wall-engaging pad of said wall-engaging member to engage a soffit under a roof overhang.

11. The perimeter cable guard system according to claim 9, wherein each said stanchion further comprises:

a lower brace and receiver member extender slidable within said lower brace and receiver member; and a parapet engagement bracket adjustably supported by the lower brace and receiver member extender for mounting the stanchion on a roof with a peripheral parapet.

12. The perimeter cable guard system according to claim 11, wherein:

said lower brace and receiver member extender has a shank having a first end adjustably secured within the inner portion of said lower brace and receiver member, and an end sleeve mounted normal to an opposite second end of said shank; and said parapet engagement bracket has an inverted T-shape formed by a shaft adjustably secured within the lower brace and receiver end sleeve and a crossbar clamp support member centrally secured to the lower end of the shaft; the system further comprising:

a pair of adjustable clamp screws extending through the crossbar clamp support member, the clamp support screws being adapted for bearing against an inner side of a parapet in order to attach the stanchion to a roof having a parapet structure.

13. The perimeter cable guard system according to claim 9, wherein each said stanchion further comprises at least one additional roof mount support, the at least one additional roof mount support being an elongated, tubular member having a first end pivotally attached to said vertical member and an opposite end having a plate attached thereto adapted for attachment to the roof.

14. The perimeter cable guard system according to claim 9, wherein said at least one pair of barrier cable engagement brackets includes three pairs of barrier cable engagement brackets, each of said engagement brackets being a plate member attached to the vertical member sidewall, each plate member having an angled barrier cable receiving slot and a substantially vertical barrier cable retainment slot extending from the receiving slot defined therein.

15. The perimeter cable guard system according to claim 9, further comprising at least one barrier cable engagement bracket attachment, the bracket attachment having:

a planar base portion having a shaft extending normal thereto;

a pair of substantially vertical, rearwardly extending wall members extending normal to the base member; and a rotatable bushing having a cylindrical body portion and an enlarged, outwardly extending circular flange at one end of the body portion, the bushing being rotatably mounted on the shaft; and a fastener member attaching the wall members of the engagement bracket attachment to said at least one pair of barrier cable engagement brackets, whereby said at least one barrier cable may engage and be supported by said base portion and said rotatable bushing.

16. The perimeter cable guard system according to claim 9, further comprising at least one mid-span support, the at least one mid-span support including a substantially vertical support post having a top end and a bottom end, a horizontal base plate member at the bottom end of the vertical support post, and at least one pair of mid-span barrier cable support brackets, each of the support brackets being a plate member attached to a sidewall of the vertical support post, each plate member having defined therein an angled receiving slot and a substantially vertical retainment slot extending from the receiving slot, the mid-span support being adapted for placement between stanchions of the perimeter cable guard system, said at least one barrier cable being engaged in and supported by the vertical retainment slots of the support brackets.

17. The perimeter cable guard system according to claim 9, wherein said vertical member is bent at an angle so that the upper portion of said vertical member extending above said anchor bracket slopes inward over the periphery of the roof in order to set the barrier cables back from an edge of the roof.

18. A stanchion for a roof perimeter cable guard system for installation around a periphery of a roof, the stanchion comprising:

a vertical member having an upper end portion, and a lower portion;

at least one pair of barrier cable engagement brackets mounted on the vertical member for releasably supporting at least one barrier cable;

an anchor bracket having an upper horizontal portion adapted for attachment to the periphery of the roof and a vertical portion adapted for abutting a wall normal to the roof, the lower portion of the vertical member being attached to the vertical portion of the anchor bracket;

a main brace member having a linear upper portion joined to the upper portion of the vertical member adjacent the upper end portion thereof at an acute angle and an arcuate lower portion curved towards, and extending lower than, the lower portion of the vertical member, the lower portion of the main brace member having a main brace lower sleeve attached thereto; and a wall-engaging member having an elongate shank portion slidable within the main brace lower sleeve, a wall-engaging pad at an end of the shank portion for engagement with the wall, and means for selectively fixing the shank portion in order to adjust the length of the wall-engaging member to support the main brace member against the wall with the main brace member extending outward from the roof.

* * * * *